US005247951A

United States Patent [19]

Machida et al.

[11] Patent Number: 5,247,951

[45] Date of Patent: Sep. 28, 1993

[54] EXTRUSION APPLICATOR FOR COSMETIC LIQUID

[75] Inventors: Takao Machida, Chiba; Satoru Takada, Ibaraki; Kiyoaki Suzuki, Saitama, all of Japan

[73] Assignee: Ohto Kabushiki Kaisha, Tokyo, Japan

[21] Appl. No.: 938,456

[22] Filed: Sep. 1, 1992

[30] Foreign Application Priority Data

May 11, 1992 [JP] Japan ..... 4-030250[U]

[51] Int. Cl.[5] ..... A45D 40/26

[52] U.S. Cl. ..... 132/218; 132/317; 132/320; 401/129; 401/269

[58] Field of Search ..... 132/218, 317, 318, 320, 132/114, 116; 401/129, 269

[56] References Cited

U.S. PATENT DOCUMENTS

| | | | |
|---|---|---|---|
| 2,274,311 | 2/1942 | Wehn | 132/320 |
| 2,782,438 | 2/1957 | Wittnebert | 401/269 |
| 2,866,994 | 1/1959 | Neely | 401/269 |
| 3,181,539 | 5/1965 | Aston | 132/218 |
| 3,353,721 | 11/1967 | Love | 132/114 |
| 3,468,612 | 9/1969 | Aston | 132/320 |
| 3,520,311 | 7/1970 | Iesersek et al. | 132/116 |
| 4,447,169 | 5/1984 | Vartoughian | 401/269 |
| 4,744,377 | 5/1988 | Dolan, Jr. | 132/218 |
| 4,987,911 | 1/1991 | Powers | 132/218 |

FOREIGN PATENT DOCUMENTS

| | | | |
|---|---|---|---|
| 0208394 | 1/1987 | European Pat. Off. | 132/320 |
| 1-115415 | 8/1989 | Japan . | |

*Primary Examiner*—John J. Wilson
*Assistant Examiner*—Frank A. LaViola
*Attorney, Agent, or Firm*—Wenderoth, Lind & Ponack

[57] ABSTRACT

A cosmetic liquid applicator having a tubular shaft, a rotary knob at a rear end of the shaft and a piston axially slidable in the shaft upon rotation of the rotary knob. A nib, mounting to a forward end of the tubular shaft, has a passage communicating with a liquid chamber. A plurality of radially extending pojections are provided so that they are gradually reduced in diameter in the forward direction. A discharge hole is communicated with the passage, and a slot extends forwardly and rearwardly from the discharge hole in opposite directions of and transverse to the projections.

3 Claims, 2 Drawing Sheets

EXTRUSION APPLICATOR FOR COSMETIC LIQUID

BACKGROUND OF THE INVENTION

The present invention relates to, but is not particularly limited to, a cosmetic-liquid applicator for discharging a cosmetic liquid of comparatively high viscosity, such as a mascara, and applying the discharged cosmetic liquid to a desired portion.

Conventionally, a general type of tool for applying a cosmetic liquid such as mascara includes an applying part utilizing either a rod member having a helical groove or a wire-like helical member to which a multiplicity of bristles are implanted or fixed by clamping, and an independent tubular container in which the cosmetic liquid is accommodated. In use, the applying part is inserted into the tubular container to apply the cosmetic liquid to the applying part.

The greatest disadvantage of this kind of applicator is that since the cosmetic liquid inside of the tubular liquid container is applied to the applying part by inserting the applying part into the tubular liquid container, the amount of cosmetic liquid applied to the applying part depends on the amount of cosmetic liquid remaining in the tubular liquid container. In use, delicate and time-consuming uniform application of the cosmetic liquid is required, and it is structurally necessary to provide a brush portion or a projection for effecting such uniform application.

To eliminate the above disadvantage, applicators of a type different from the aforesaid one have been developed and widely used. This type of applicator includes a tubular shaft in which a liquid chamber is formed, and a piston is accommodated in the tubular shaft. A cosmetic liquid inside the liquid chamber is extruded in the forward direction by movement of the piston. Such a piston type of applicator is useful in that a predetermined amount of cosmetic liquid can be discharged by controllably rotating a rotary knob provided on the rearward end portion of the applicator, as shown in Japanese Utility Model Application No. 63-7914/1988 assigned to the present assignee.

However, the aforesaid conventional type of extrusion applicator has the disadvantage that the extruded cosmetic liquid often fails to uniformly spread over the applying part and an excessive amount of cosmetic liquid is discharged into one particular portion. Accordingly, to uniformly spread the cosmetic liquid, a separate uniforming element is needed.

SUMMARY OF THE INVENTION

An object of the invention is to provide an improved extrusion applicator for a cosmetic liquid capable of discharging the cosmetic liquid to uniformly spread it over the entire applying part.

According to this invention, there is provided an extrusion applicator for a cosmetic liquid which comprises: a cosmetic-liquid extruding device including a rotary knob secured to the rearward end portion of a tubular shaft having a liquid chamber for accomodating the cosmetic liquid, and a piston which is axially slidable in the tubular shaft upon rotation of the rotary knob 11; and an applying part(or nib) engaged with the forward end portion of the tubular shaft and provided on a forward side of the liquid chamber. The applying part comprises a passage having a rearward end portion communicating with the liquid chamber and a closed forward end portion, a multiplicity of radially expanding projection pieces spaced apart from each other at equal intervals on an outer periphery of the applying part, at least one discharge hole provided between adjacent projection pieces, the aforesaid at least one discharge hole being formed to communicate with the passage, and a slot formed to extend from the discharge hole in forward and rearward directions such as to be transverse to the multiplicity of projection pieces. The multiplicity of projection pieces being gradually reduced in diameter in the forward direction.

In a preferred embodiment of this invention, a cap is provided with an internal wall tapered in the forward direction according to a geometrical configuration defined by the multiplicity of projection pieces which are gradually reduced in diameter in the forward direction.

PREFERRED EMBODIMENTS OF THE INVENTION

A specific embodiment of the present invention will be described with reference to FIGS. 1–4 of the drawings.

Figure 1A:
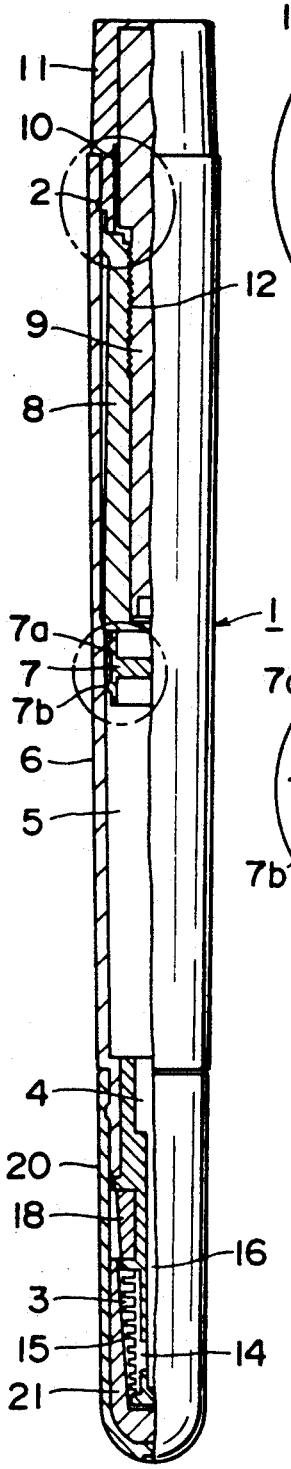
FIG. 1A is a partially, cross-sectional view of an extrusion applicator for a cosmetic liquid according to the embodiment of this invention, showing the state in which a cap is attached.
Figure 1B:
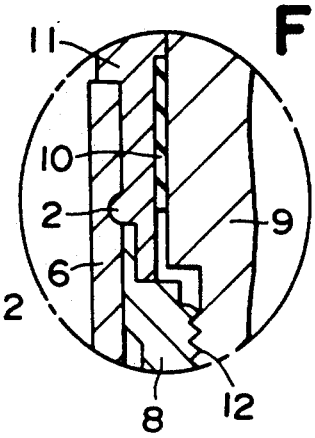
FIGS. 1B and 1C are enlarged cross-sectional views of portions of the application shown in FIG. 1A.
Figure 1C:
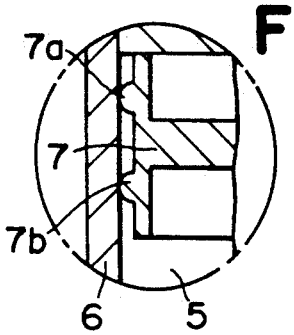

Referring to FIGS. 1A–1C which show an entire structure of an extrusion applicator 1 for a cosmetic liquid according to the present invention, a cup-shaped rotary knob 11 having an engagement projection 2 on its outer periphery is rotatably fitted into the rearward end portion of an elongated hollow tubular shaft 6.

A rotary rod 9 is fitted into a recess in the rotary knob 11 by means of a leaf spring 10 and extends forward from the rotary knob 11. A threaded portion 12 is formed around an outer peripheral portion of the rotary rod 9, and a sliding tube 8 is disposed outside of the rotary rod 9 in such a manner as to be slidably but non-rotatably engaged with the tubular shaft 6. As the rotary rod 9 rotates with the rotation of the rotary knob 11, the sliding tube 8 outside of the rotary rod 9 can slide in the axial direction thereof within the tubular shaft 6.

A piston 7 is disposed on the forward end of the sliding tube 8. The piston 7 is liquid-tightly fitted into the tubular shaft 6 for sliding motion along the inner wall thereof so that the piston 7 can slide in the liquid chamber 5 in the tubular shaft 6 in the axial direction thereof. In the illustrated embodiment, the piston 7 has two projections **7*a* and 7*b* formed around its outer periphery. However, the piston 7** may have any other desired form, for example, a form in which a single projection is provided in the middle portion of the outer periphery.

The above-described structure is substantially similar to that disclosed in Japanese Utility Model Application No. 63-7914/1988 (Japanese Utility Model Laid-Open No. 1-115415/1989). However, the invention is distinct from that disclosed in the prior application with regard to the following points.

Figure 2:
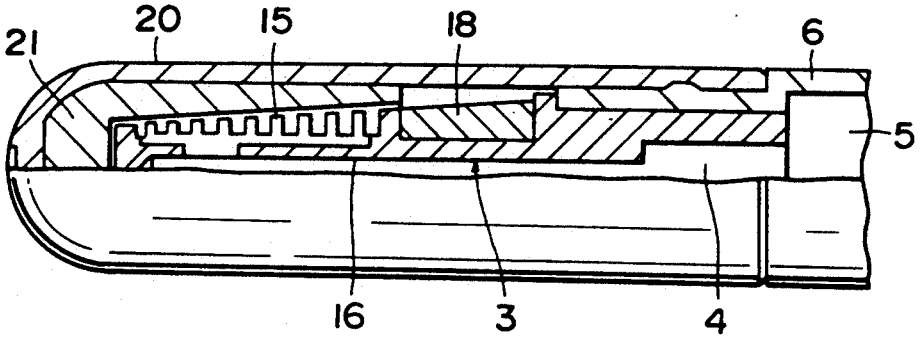
FIG. 2 is an enlarged partially cross-sectional view showing the structure of an applying part of the applicator of FIG. 1.
Figure 3:
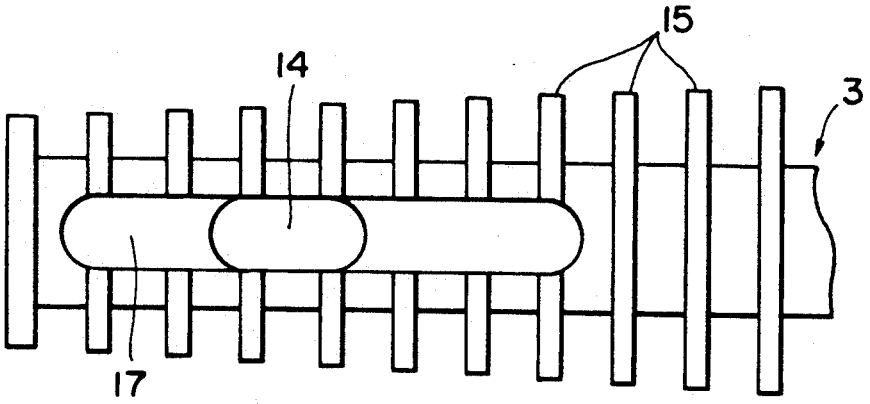
FIG. 3 is a top plan view showing the structure of the applying part provided in the applicator according to this invention.
Figure 4:
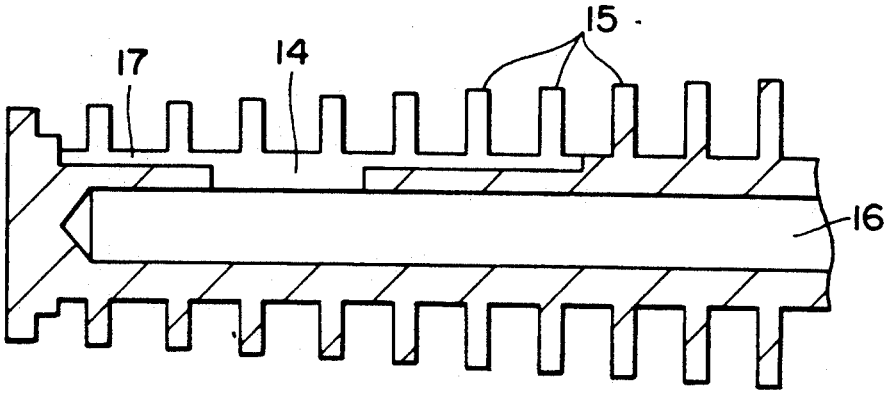
FIG. 4 is a sectional view of the applying part shown in FIG. 3.

Referring to FIGS. 2, 3 and 4, an applying part 3, that is, a nib for applying a cosmetic liquid, is disposed on the forward side of the liquid chamber 5 in such a manner that the rearward end potion of the applying part 3 is fitted into the forward end portion of the tubular shaft 6. The applying part 3 is formed of a synthetic resin such as PP (polypropylene), polyethylene or ABS resin, and has a liquid passage 16 which is closed at its forward end. The liquid passage 16 communicates with the liquid chamber 5 through the guide hole 4, and a plurality of radially extending projection pieces 15, each having a circular shape, are formed around the outer periphery of the applying part 3 in such a manner that the projection pieces 15 are arranged at equally spaced axial intervals. The projection pieces 15 which are formed at such equally spaced axial intervals are gradually reduced in diameter toward the forward end and, as a whole, constitute a tapered geometrical configuration which becomes progressively narrower toward the forward end.

A discharge hole 14 which communicates with the liquid passage 16 and is opened to the outside is provided in the shaft portion of the applying part 3. An elongated, shallow recess 17 which extends in the axial direction transversely to the multiplicity of projection pieces 15 is provided to extend forwardly and rearwardly from the discharge hole 14 in the forward as shown in FIG. 4. A cosmetic liquid which is fed under pressure into the liquid passage 16 through the guide hole 4 is discharged through the discharge hole 14, and the discharged liquid is extruded into the recess 17 and is uniformly fed into a multiplicity of gaps between the projection pieces 15.

In FIG. 2, reference numeral 18 denotes a guide tube disposed on the rearward side of the array of the projection pieces 15. The guide tube 18 has a tapered external shape and serves to facilitate detachment and attachment of a cap 20 which will be described later. Although the guide tube 18 is provided as a part separate from the applying part 3, it may be formed integrally with the applying part 3. The guide tube 18 may be omitted if there is no adverse effect on the detachment and attachment of the cap 3.

Referring to FIG. 2, an internal cap 21 having a tapered internal face is fitted into the cap 20 which is releasably adaptable, and the degree of taper of the tapered internal face is selected to coincide with the degree by which the projection pieces 15 of the applying part 3 are gradually reduced in diameter. In this arrangement, slight gaps between the projection ends of the respective projection pieces 15 and the internal face of the internal cap 21 are kept constant. Accordingly, the cosmetic liquid fed under pressure is discharged through the discharge hole 14 and diffused into the shallow recess 17 so that the cosmetic liquid can be fed into the gaps between every adjacent pair of projection pieces 15. If an excess amount of cosmetic liquid is partially discharged, it can be uniformly dispersed over the entire applying part 3 by means of the tapered internal face of the internal cap 21. It is to be noted that although the internal cap 21 is separately formed, the internal wall surface of the cap 20 may be tapered similarly to the tapered internal face of the internal cap 21 so that the cap 20 and the internal cap 21 are integrally formed.

The operation of the applicator according to the present invention will now be described. As the rotary knob 11 provided at the rearward end portion of the tubular shaft 6 is manually rotated by a user, the rotary rod 9 rotates and the sliding tube 8 screwed onto the threaded portion 12 of the rotary rod 9 slides in the axial direction (in the forward direction), thereby causing the piston 7 to advance. Thus, the cosmetic liquid (for example, a mascara) inside of the liquid chamber 5 is forced under pressure to pass through the guide hole 4 in the applying part 3 and is in turn discharged through the discharge hole 14. The discharged cosmetic liquid is forced out through the discharge hole 14 and the shallow recess 17 which is formed to extend forwardly and rearwardly from the discharge hole 14. In this manner, the cosmetic liquid is discharged and forced to uniformly diffuse into the respective gaps between the multiplicity of projection pieces 15, to which the cosmetic liquid is fed. The applying part 3 including the multiplicity of radially extending projection pieces 15 is gradually reduced in diameter in the forward direction and has an approximately tapered geometrical configuration. In addition, since the elongated shallow recess 17 is formed to extend forwardly and rearwardly from the discharge hole 14 in a direction transverse to the multiplicity of projection pieces 15, the cosmetic liquid forced out of the liquid chamber 5 is forced to flow uniformly into the gaps between the respective projection pieces 15. Since the internal cap 21 in the cap 20 has a tapered shape according to the geometrical configuration defined by the external diameters of the respective projection pieces 15, even if the cosmetic liquid is forced out while the cap 20 is inserted over the applying part 3, the cosmetic liquid is spread far more uniformly so that it can be uniformly applied to the entire targets to which the cosmetic liquid is to be fed.

According to the present invention, the applying part 3 has the liquid passage 16 communicating with the liquid chamber 5, and the discharge hole 14 communicating with the liquid passage 16. The elongated shallow recess 17 is formed to extend forwardly and rearwardly from the discharge hole 14, and the multiplicity of projection pieces 15 having diameters which are gradually reduced toward the forward end are formed along the applying part 3 at equally spaced axial intervals. Accordingly, the cosmetic liquid discharged from the liquid chamber 5 can be uniformly diffused into the gaps between the respective projection pieces 15 through the recess 17. Accordingly, since the cosmetic liquid can be uniformly spread over the applying part 3, it is, in use, not necessary to uniformly spread the cosmetic liquid by utilizing a separate uniforming element as has been used in the conventional applicator. It is, therefore, possible to easily achieve uniform application of the cosmetic liquid.

What is claimed is:

1. An extrusion applicator for a cosmetic liquid, comprising:

a tubular shaft having a forward end, a rearward end and a liquid chamber for accommodating the cosmetic liquid;

an extrusion device including a rotary knob mounted to the rearward end of said tubular shaft, and a piston which is axially slidably mounted in said tubular shaft and is operably connected with said rotary knob so as to be axially slid upon rotation of said rotary knob;

an applying part engaged with the forward end of said tubular shaft at a position forward of said liquid chamber;

a plurality of projections extending radially outwardly from an outer periphery of said applying part and being equally spaced apart from one another to form gaps between adjacent pairs of said projections, said projections being gradually reduced in diameter toward a forward end of said applying part;

wherein a passage is formed in said applying part in communication with said liquid chamber and extending forwardly therefrom;

wherein a discharge hole in communication with said passage is formed in said applying part between an adjacent pair of said projections; and wherein a forwardly to rearwardly elongated recess is formed in the outer periphery of said applying part to fluidically connect with said discharge hole, said recess extending forwardly and rearwardly from said discharge hole, so as to fluidically connect said discharge hole with a plurality of said gaps formed between adjacent pairs of said projections.

2. An extrusion applicator as recited in claim 1, further comprising:

a cap removably mounted to said forward end of said tubular shaft to cover said applying part, said cap having an internal well tapered forwardly and inwardly so as to be substantially complementary in shape with said plurality of projections which are gradually reduced in diameter toward said forward end of said applying part.

3. An extrusion application for cosmetic liquid, comprising:

a tubular shaft having a liquid chamber for accommodating a cosmetic liquid;

an extrusion device having a rotary knob mounted to a rearward end portion of said tubular shaft, and a piston axially sildable in said tubular shaft with a rotation of said rotary knob;

an applying part engaged with a forward end of said tubular shaft and provided forwardly of said liquid chamber, said applying part having a passage having a rearward end portion connected with said liquid chamber and a closed forward end portion;

a plurality of radially extending projections spaced apart from each other at equal intervals on an outer periphery of said applying part, said projections being gradually reduced in diameter in the forward direction;

at least one discharge hole formed between adjacent projections, said discharge hole being formed to connect with said passage;

a slot extending from said discharge hole in forward and rearward directions and transverse to said projections; and a cap having an internal wall, wherein said internal wall is tapered in a forward direction according to a geometrical configuration defined by said projections gradually reduced in diameter in the forward direction.

* * * * *